US007169351B2

(12) United States Patent
Bengtsson et al.

(10) Patent No.: US 7,169,351 B2
(45) Date of Patent: Jan. 30, 2007

(54) METHOD OF PRODUCTION OF SURFACE DENSIFIED POWDER METAL COMPONENTS

(75) Inventors: Sven Bengtsson, Höganäs (SE); Yang Yu, Höganäs (SE); Martin Svensson, Helsingborg (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 10/311,973

(22) PCT Filed: Jun. 25, 2001

(86) PCT No.: PCT/SE01/01441

§ 371 (c)(1),
(2), (4) Date: Jan. 28, 2003

(87) PCT Pub. No.: WO02/00378

PCT Pub. Date: Jan. 3, 2002

(65) Prior Publication Data

US 2003/0155041 A1 Aug. 21, 2003

(30) Foreign Application Priority Data

Jun. 28, 2000 (SE) ..... 0002448

(51) Int. Cl.
*B22F 3/10* (2006.01)

(52) U.S. Cl. ..... 419/28; 419/29

(58) Field of Classification Search ..... 419/28, 419/29, 26

See application file for complete search history.

(56) References Cited

U.S. PATENT DOCUMENTS 4,006,016 A * 2/1977 Zambrow et al. ..... 419/28
4,059,879 A 11/1977 Chmura et al.
4,145,798 A * 3/1979 Sarnes ..... 419/27
4,165,243 A * 8/1979 Sarnes et al. ..... 419/28
4,266,974 A * 5/1981 Nitta et al. ..... 420/8
4,277,544 A * 7/1981 Pietrocini ..... 428/547
4,427,460 A * 1/1984 Araki et al. ..... 148/500
4,497,874 A * 2/1985 Hale ..... 428/551
4,614,638 A * 9/1986 Kuroishi et al. ..... 419/39
4,954,171 A 9/1990 Takajo et al.
5,009,842 A * 4/1991 Hendrickson et al. ..... 419/28
5,462,808 A * 10/1995 Asabe et al. ..... 428/551
5,540,883 A * 7/1996 Jones et al. ..... 419/28
5,613,180 A * 3/1997 Kosco ..... 419/5
5,681,651 A * 10/1997 Yoshimura et al. ..... 428/216
5,729,822 A 3/1998 Shivanath et al.
5,884,527 A * 3/1999 Cole et al. ..... 74/434
5,915,162 A * 6/1999 Uchino et al. ..... 428/551
5,997,805 A 12/1999 Lawcock et al.
6,110,419 A * 8/2000 Buckley-Golder et al. .... 419/28
6,171,546 B1 * 1/2001 M.ang.rs et al. ..... 419/38

(Continued)

FOREIGN PATENT DOCUMENTS

EP 0 600 421 6/1994

(Continued)

*Primary Examiner*—George P. Wyszomierski
(74) *Attorney, Agent, or Firm*—Buchanan Ingersoll & Rooney PC

(57) ABSTRACT

A method for densification of the surface layer of an optionally sintered powder metal component comprising the steps of decarburizing the surface layer for softening the surface layer of the component, and densifying the surface layer of the component.

22 Claims, 2 Drawing Sheets

De-C: Decarburization
De-C + SP:Decarburization + Surface pressing

U.S. PATENT DOCUMENTS 6,592,809 B1 * 7/2003 Anderson et al. ..... 419/28

FOREIGN PATENT DOCUMENTS

GB 2 250 227 6/1992
JP 61-264105 11/1986
JP 409194908 A * 7/1997
WO WO 98/16338 4/1998

* cited by examiner

De-C: Decarburization
De-C + SP:Decarburization + Surface pressing

METHOD OF PRODUCTION OF SURFACE DENSIFIED POWDER METAL COMPONENTS

FIELD OF THE INVENTION

The present invention concerns a process of producing powder metal components. Specifically the invention concerns a process of producing powder metal components having a high core strength and a hard, densified surface.

BACKGROUND OF THE INVENTION

Traditional methods for the manufacture of metal parts include, for example, machining from forging, bar stock or tube. However, these traditional methods of manufacture have poor material utilization and relatively high cost versus production by Powder Metallurgy (PM) processes. Other advantages with PM processes include the ability to form complex shapes in a single forming operation, minimal finish machining, high volume capacity and energy efficiency.

Notwithstanding the advantages referred to above, the utilization of PM sintered parts in automobiles is still relatively modest when compared to low alloy wrought steel. One area of future growth in the utilization of PM parts in the automotive industry resides in the successful entry of PM parts into more demanding applications, such as power transmission applications, for example, transmission gears. One problem with gear wheels formed by the PM process in the past has been that powder metal gears have reduced bending fatigue strength in the tooth and root region of the gear, and low wear resistance on the tooth flanks due to the residual porosity in the microstructure versus gears machined from bar stock or forgings. One method of successfully producing PM transmission gears resides in rolling the gear profile to densify the surface as shown in GB 2250227B. However, this process teaches a core density which is lower than that in the densified regions, which is typically at around 90% of full theoretical density of wrought steel. This results in a tooth with comparatively lower bending fatigue endurance than its machined wrought steel counterpart.

Although sintering temperature can have a significant influence on dynamic properties of a sintered PM part at a given density, the ultimate dynamic property levels attainable for any sintering regime is also controlled by the combination of alloying system used and sintered density attained. Although it is possible to obtain high tensile strength with typical PM processes (with or without heat treatment) at single pressed density levels of up to 7.2 g/cm$^3$, dynamic properties such as fracture toughness and fatigue endurance under cyclic loading will invariably be less than those of steel of comparable strength. Therefore, processes for the production of PM transmission gears have not gained wide support. This is primarily due to the negative effects of residual porosity. Accordingly, processes to improve properties of PM parts subjected to high loading must consider densification and microstructure of the highly loaded regions for good cyclic bending endurance and surface endurance respectively.

Methods for improving the properties of PM parts are known from the U.S. Pat. Nos. 5,729,822, 5,540,883 and 5,997,805.

U.S. Pat. No. 5,729,822 discloses a method of manufacturing PM components, useful for gears, comprising the steps of: a) sintering a powder metal blank to produce a core density of between 7,4 to 7,6 g/cm$^3$; b) rolling the surface of the gear blank to densify the surface; c) heating the rolled sintered gear and carburizing in a vacuum furnace.

U.S. Pat. No. 5,540,883 discloses a method of producing PM components, useful for bearings, comprising the steps of: a) blending carbon, ferro alloy powder and a lubricant with compressible iron powder to form a blended mixture; b) pressing the blended mixture to form the article; c) sintering the article; d) roll forming at least part of a surface of the article with rollers and e) heat treating the layer.

U.S. Pat. No. 5,997,805 discloses a method of producing high density, high carbon, sintered PM steels. The method includes: blending powders of desired composition; compacting and sintering the powder; cooling the sintered article by isothermal hold or slow cooling; followed by forming the article to a density between 7,4 to 7,7 g/cm$^3$. By cooling the sintered article followed by isothermal hold a lower hardness of the high carbon material is obtained for the following forming operation.

The present invention provides a new method for producing PM components with a core distinguished by medium to high density, high yield strength and a surface with high hardness and high density.

SUMMARY OF THE INVENTION

In brief, the present invention concerns a method for densification of the surface layer of an optionally sintered powder metal component comprising the steps of: decarburizing the surface layer for softening the surface layer of the component; and densifying the surface layer of the component.

For a component subjected to sintering the decarburisation may be performed either as part of the sintering step or as a separate process following the sintering.

The invention further concerns a sintered powder metal component of an iron alloy having a carbon-content of 0,3–1,0% in its core and 0,3–1,5%, preferably 0,5–0,9% in its case hardened outer layer.

DETAILED DESCRIPTION OF THE INVENTION

The specific reason for the decarburization is to soften the surface of the component in order to be able to perform an efficient surface densification of the component. The decarburized surface layer has a lower yield stress compared to the core. The surface layer will densify while the stresses on the core will be low. With the method according to the invention a densification can be performed on a material with a core of high yield strength and a soft surface layer using normal pressures and tool materials. The resulting component will have high dimensional accuracy and high core strength. After the surface-densification the surface is optionally case hardened or subjected to other comparable surface hardening methods in order to increase the surface hardness and wear-resistance. The surface will reach a hardness superior to the core material due to its higher density and case hardened layer and the bending fatigue and the rolling contact fatigue properties increase substantially. The core of the component maintains throughout the process the optimum carbon content for high tensile and yield strength.

Preferred powders which may be used according to the present invention are iron powders or iron-based powders optionally including one or more alloying element. The powder may e.g. include up to 10% of one or more alloying elements selected from the group consisting of Cu, Cr, Mo, Ni, Mn, P, V and C. The powders may be in the form of powder mixtures, pre-alloyed powders and diffusion-bonded alloying powders or combinations thereof.

The compacting is performed at a pressure of 400–1000 MPa, preferably 600–800 MPa.

The sintering is performed at 1100–1350° C., the conventional temperatures for pre-alloyed and partially pre-alloyed iron.

The decarburization is performed at a temperature of 750–1200° C., preferably 850–1000° C. in a controlled atmosphere. The atmosphere is preferably made up of hydrogen or a mixture of nitrogen and hydrogen with optional additions of $H_2O$, especially good results have been obtained with a nitrogen/hydrogen mixture where 50–100% of the hydrogen is saturated with $H_2O$.

The thickness of the decarburized layer is 0,1–1,5 mm, preferably 0,8–1,2 mm and the carbon content 0–0,5%, preferably 0,03–0,3%.

Due to the low carbon content of the surface of the component, the material is soft when it is being mechanically worked. The surface layer reaches full density due to the mechanical working, which means that the full potential of the material can be utilised. The thickness of the layer should be sufficient to accommodate the stresses produced by the service environment of the component.

The surface densification may be performed by mechanical forming such as surface pressing, surface rolling, shot peening, sizing or any other method that is capable of increasing the density of the component locally. There is however a significant difference between sizing and rolling. The primary objective of the sizing operation is to improve shape tolerance, while increasing the local density is only a secondary objective.

The rolling operation is the key to reach properties comparable to wrought and case hardened steel. However, as a secondary function the rolling operation results in an improved shape tolerance. The exact rolling sequence and other parameters relevant to the rolling must be tailor-made for the component in question.

A case hardening following the densification will yield a very dense and hard surface. The case hardening is performed at a temperature of 850–1000° C., preferably 900–950° C. in an atmosphere enriched with 0,3–1,5% carbon, preferably 0,5–0,9% carbon. The term "case-hardening" is meant to include any type of surface hardening that includes the addition of a hardening agent, i.e. carbon or nitrogen. Typical hardening methods include: traditional case hardening, carbo nitriding, nitro carburizing, plasma nitriding, ion nitriding etc.

The carbon content of the surface layer is 0,3–1,5%, preferably 0,5–0,9% after the case hardening. The carbon content of the core is maintained at 0,3–1,0%.

The case hardening is preferably followed by tempering at a low temperature in air.

The invention will now be further-described with the following example.

EXAMPLE

Iron based alloys with compositions according to table 1 were prepared. The powder mixtures were compacted into test components with a compacting pressure of about 600 MPa to give a green density of about 7,0 g/cm$^3$. The compacted components were thereafter treated to the five different decarburization processes shown below:

A. Sintering at 1120° C./30 min in 30% $N_2$/70% $H_2$, followed by cooling at 0,5–2,0° C./s.

B. (Single process) Sintering at 1120° C./25 min in 90% $N_2$/10% $H_2$, followed by sintering (decarburization) at 1120° C./5 min in 33% of wet and 67% of dry 90% $N_2$/10% $H_2$ and cooling at 0,5–2,0° C./s in 33% of wet and 67% of dry 90% $N_2$/10% $H_2$.

C. (Single process) Sintering at 1120° C./25 min in 90% $N_2$/10% $H_2$, followed by sintering (decarburization) at 1120° C./5 min in 20% of wet and 80% of dry 90% $N_2$/10% $H_2$ and cooling at 0,5–2,0° C./s in 20% of wet and 80% of dry 90% $N_2$/10% $H_2$.

D. Sintering at 1120° C./30 min in endogas with 0,65% of $CO_2$, followed by cooling at 0,5–2,0° C./s.

E. (Double process) Sintering at 1120° C./30 min in 30% $N_2$/70% $H_2$, followed by decarburization at 950° C./20 min in 50% wet and 50% dry $H_2$ and cooling at 0,5–2,0° C./s.

TABLE 1

| No | Material* | % initial Carbon** | Alloys | Type of powder |
|---|---|---|---|---|
| 1 | Distaloy AE | 0.6 | 0.5% Mo, | Diffusion |
| 2 | Distaloy AE | 0.5 | 1.5% Cu, | bonded |
| 3 | Distaloy AE | 0.4 | 4% Ni | |
| 4 | Astaloy Mo | 0.6 | 1.5% Mo | pre-alloyed |
| 5 | Astaloy Mo | 0.5 | | |
| 6 | Astaloy Mo | 0.4 | | |

*+0.6% Kenolube
**added as graphite

Surface densification was performed on the components by surface rolling under the rolling force of 15–35 kN and the rolling revolution 5–40 R.

Case hardening was performed on the densified parts by subjecting the parts to 950° C./60 min in an atmosphere of 0,5% carbon potential followed by tempering at 185° C./60 min in air.

In order to characterize the effect of the decarburization and its influence on the surface densification, surface hardness measurements (HV10) and micro-structure observations (LOM) of cross-sections of the decarburized components were performed. The analysis gives information of both the surface hardness and the thickness of the soft decarburized layer.

Figure 1:
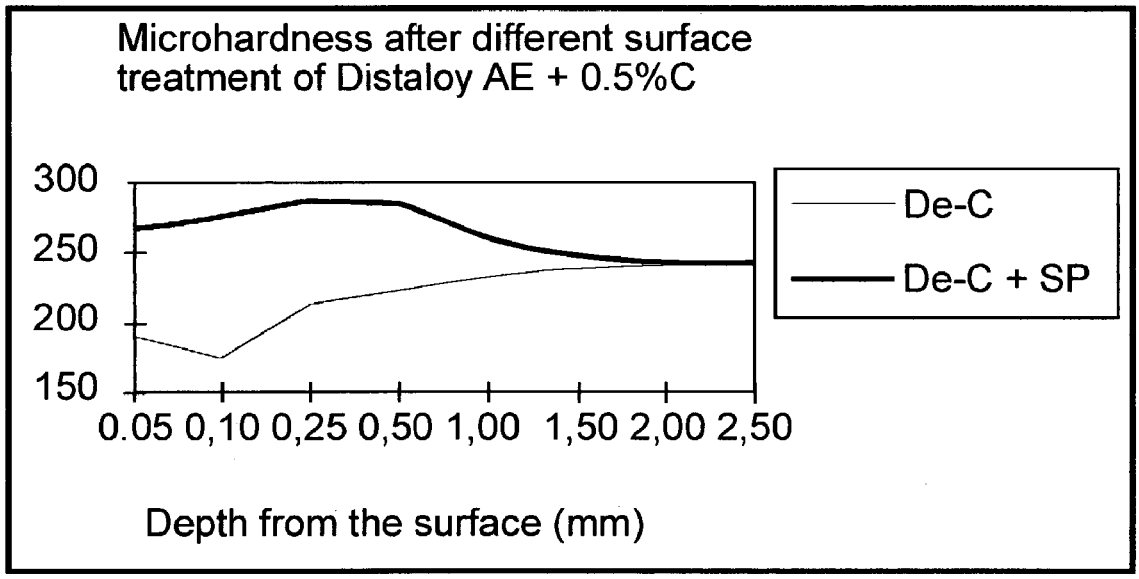
FIG. 1 is a graph showing the microhardness after different surface treatments.

The results of the surface hardness measurements are shown in table 2 and FIG. 1. It is clearly seen that the surface hardness decreases after the decarburization and increases after surface densification and case hardening.

Figure 2:
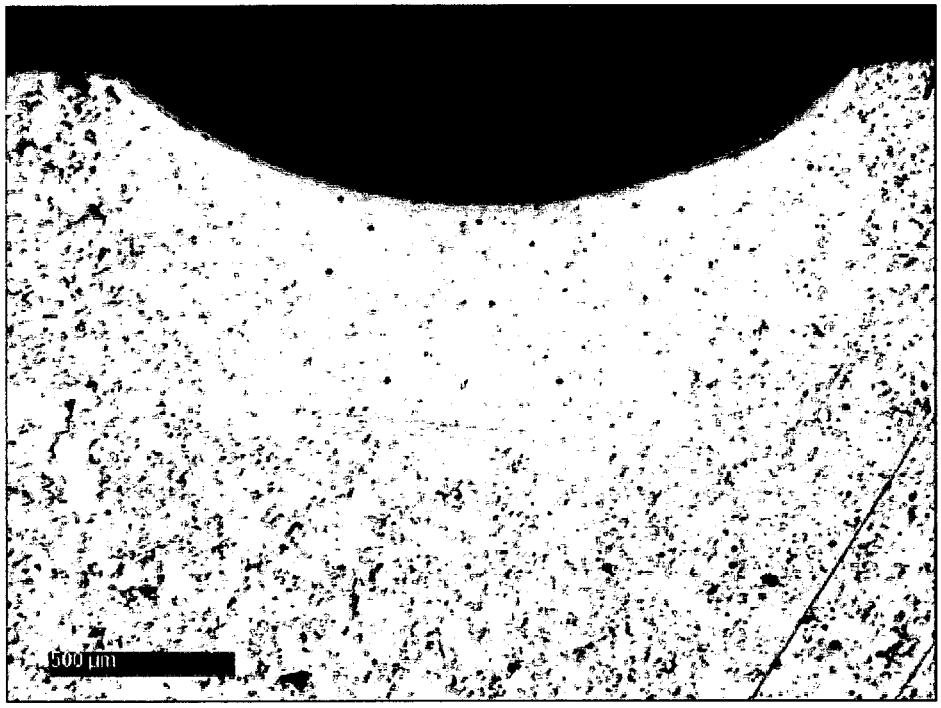
FIG. 2 is a picture showing the result of surface pressing on a decarburized surface.
Figure 3:
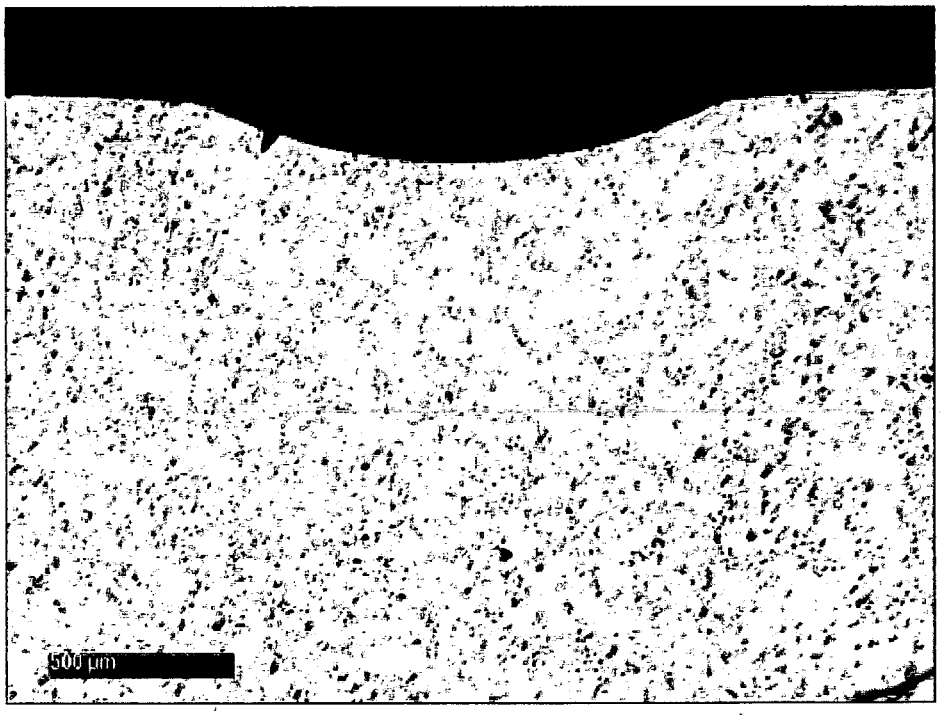
FIG. 3 is a picture showing the result of surface pressing on an as sintered sample.

FIGS. 2 and 3 shows the impact of surface pressing (pressing force 60 kN) on a decarburized and as sintered surface respectively (material: Distaloy AE+0,6% C).

TABLE 2

| No | Surface hardness (HV10) As sintered | Decarb. by process B (33% wg*) | Decarb. by process C (22% wg) | Carbur. to 0.5% carbon |
|---|---|---|---|---|
| 1 | 274 | 138 | 148 | 466 |
| 3 | 221 | 122 | 154 | 456 |
| 4 | 210 | 118 | 152 | 435 |
| 6 | 173 | 81 | 87 | 593 |

*wg = wet gas

The carbon contents after the different decarburization processes are shown in table 3. From the table it can be seen that a separate decarburization process (process E, the double process) gives a much larger effect of the surface decarburization than the single processes (process B and C), although the latter has a certain effect of the decarburization. Compared to the single and double processes sintering has a very limited effect on surface decarburization. This is mainly determined by the kinetic effect during the reaction.

TABLE 3

| No | Carbon content (%) Initial Carbon | As sintered | Decarb. by process B (20% wg*) | Decarb. by process C (33% wg) | Decarb. by process E (DP**) (50% wg) |
|---|---|---|---|---|---|
| 1 | 0.6 | 0.52 | 0.48 | 0.43 | 0.28 |
| 3 | 0.4 | 0.37 | 0.31 | 0.28 | 0.17 |
| 4 | 0.6 | 0.58 | 0.49 | 0.44 | 0.26 |
| 6 | 0.4 | 0.39 | 0.32 | 0.28 | 0.17 |

*wg = wet gas
**DP = Double Process

The carbon measurement was performed on the whole volume and not on the surface of the sample. The carbon content on the surface of the sample should be much lower than the now measured value.

Tensile tests were performed on samples sintered at 1120° C. for 30 minutes under a 90% $N_2$/10% $H_2$ atmosphere. The results are shown in table 4.

TABLE 4

| No | Content of carbon (%) | Tensile strength/Yield strength (sintered at 1120° C./30 min)* |
|---|---|---|
| 1 | 0.6 | 732/400 |
| 2 | 0.5 | 734/398 |
| 3 | 0.4 | 686/376 |
| 4 | 0.6 | 550/425 |
| 5 | 0.5 | 537/421 |
| 6 | 0.4 | 518/407 |

*Atmosphere: 90% $N_2$/10% $H_2$

The invention claimed is:

1. A method for densification of the surface layer of a carbon containing component prepared from an iron or iron-based powder, comprising the steps of:

sintering a pressed carbon containing component prepared from an iron or iron-based powder;

after sintering, decarburizing the surface layer for softening the surface layer of the component; and densifying the surface layer of the component by increasing the density of the component locally such that the surface layer has a higher density than the core material of the component.

2. Method according to claim 1, wherein the decarburization is performed during conditions sufficient to provide a soft surface layer having a thickness of 0.1–1.5 mm.

3. Method according to claim 2, wherein the surface densification is followed by case hardening.

4. Method according to claim 1, wherein the decarburization is performed during conditions sufficient to provide a carbon content of 0–0.5% by weight in the soft surface layer of the component.

5. Method according to claim 4, wherein the surface densification is followed by case hardening.

6. Method according to claim 1, wherein the surface densification is followed by case hardening.

7. Method according to claim 6, wherein the case hardening is performed as a carburization process.

8. Method according to claim 7, wherein the case hardening is performed during conditions sufficient to provide a carbon content of 0.3–1.5% by weight in the surface layer of the component.

9. Method according to claim 7, wherein the carbon content is 0.3–1.0% by weight in the core of the case hardened component.

10. Method according to claim 6, wherein the case hardening is performed during conditions sufficient to provide a carbon content of 0.3–1.5% by weight in the surface layer of the component.

11. Method according to claim 10, wherein the carbon content is 0.3–1.0% by weight in the core of the case hardened component.

12. Method according to claim 6, wherein the carbon content is 0.3–1.0% by weight in the core of the case hardened component.

13. Method according to claim 6, wherein the case hardening is performed during conditions sufficient to provide a carbon content of 0.5–0.9% by weight in the surface layer of the component.

14. Method according to claim 1, wherein the decarburization comprises heating the component at 750–1200° C. in a controlled atmosphere.

15. Method according to claim 1, wherein the component includes one or more alloying elements selected from the group consisting of Cu, Cr, Mo, Ni, Mn, P, V and C.

16. A method according to claim 1, wherein the surface layer of the carbon containing component is sintered.

17. Method according to claim 1, wherein the decarburization is performed during conditions sufficient to provide a soft surface layer having a thickness of 0.8–1.2 mm.

18. Method according to claim 1, wherein the decarburization is performed during conditions sufficient to provide a carbon content of 0.03–0.3% by weight in the soft surface layer of the component.

19. Method according to claim 1, wherein the decarburization comprises heating the component at 850–1,000° C. in a controlled atmosphere.

20. Method according to claim 1, wherein the densifying of the surface layer of the component is by a method selected from the group consisting of surface pressing, surface rolling, shot peening and sizing.

21. A method for producing powder metal components having high density and densified surface, comprising the steps of:

sintering a pressed component, then decarburizing the surface layer of the sintered component for softening the surface layer; and densifying the softened surface layer of the component by increasing the density of the component locally such that the surface layer has a higher density than the core material of the component.

22. A method for producing a sintered powder metal component having a densified surface layer, comprising:

sintering a pressed carbon containing component prepared from an iron or iron-based powder;

after sintering, decarburizing the surface layer for softening the surface layer of the component;

densifying the surface layer of the component by increasing the density of the component locally such that the surface layer has a higher density than the core material; and case hardening the densified surface layer;

wherein the component comprises a core having a carbon-content of 0.3–1.0% and a case hardened outer layer having a carbon-content of 0.3–1.5%.

* * * * *